US008384562B2

(12) United States Patent
Wall et al.

(10) Patent No.: US 8,384,562 B2
(45) **Date of Patent: *Feb. 26, 2013**

(54) ADVANCED ACCESSIBLE PEDESTRIAN CONTROL SYSTEM FOR THE PHYSICALLY DISABLED

(75) Inventors: Richard W. Wall, Moscow, ID (US); Gabriel DeRuwe, Moscow, ID (US)

(73) Assignee: University of Idaho, Moscow, ID (US)

( * ) Notice: Subject to any disclaimer, the term of this patent is extended or adjusted under 35 U.S.C. 154(b) by 937 days.

This patent is subject to a terminal disclaimer.

(21) Appl. No.: 12/411,306

(22) Filed: Mar. 25, 2009

(65) Prior Publication Data

US 2012/0223843 A1 Sep. 6, 2012

Related U.S. Application Data

(60) Provisional application No. 61/070,656, filed on Mar. 25, 2008.

(51) Int. Cl.
*G08G 1/095* (2006.01)
*G08G 1/00* (2006.01)

(52) U.S. Cl. ..... 340/944; 340/925; 340/906; 340/907; 701/433

(58) Field of Classification Search ..... 340/944, 340/925; 701/433
See application file for complete search history.

(56) References Cited

U.S. PATENT DOCUMENTS

| | | | | |
|---|---|---|---|---|
| 6,208,934 | B1 * | 3/2001 | Bechtolsheim et al. | 701/428 |
| 6,259,990 | B1 * | 7/2001 | Shojima et al. | 701/420 |
| 6,731,940 | B1 * | 5/2004 | Nagendran | 455/456.1 |
| 7,539,576 | B2 * | 5/2009 | Ohnishi et al. | 701/433 |
| 2011/0148660 | A1 * | 6/2011 | Tate et al. | 340/906 |

* cited by examiner

*Primary Examiner* — Donnie Crosland
(74) *Attorney, Agent, or Firm* — Klarquist Sparkman, LLP

(57) ABSTRACT

A mobile traffic controller to aid pedestrians includes a wireless transmitter and receiver that are configured to communicate with a traffic signal or a traffic control system. In response to a user request, the transmitter sends a traffic control request to a traffic signal or a traffic system controller. The request is acknowledged, and when appropriate, the mobile traffic controller receives a message indicating that a crossing is authorized. The mobile controller can include a vibro-tactile or audio output device for communication with the user. In addition, position and orientation systems can be included so that the user can be directed along a preferred path or alerted that a predetermined or legally established passage zone has been exited or is about to be exited.

22 Claims, 4 Drawing Sheets

ADVANCED ACCESSIBLE PEDESTRIAN CONTROL SYSTEM FOR THE PHYSICALLY DISABLED

CROSS REFERENCE TO RELATED APPLICATION

This application claims the benefit of U.S. Provisional Application No. 61/070,656, filed Mar. 25, 2008, that is incorporated herein by reference.

ACKNOWLEDGMENT OF GOVERNMENT SUPPORT

This invention was made with government support under Grant No. DTRS98-G-0027 awarded by United States of America Department of Transportation, Research and Special Programs Administration. The government has certain rights in the invention.

BACKGROUND

Traffic control systems are ubiquitous in modern transportation systems. Traffic control systems are commonly used to regulate the flow of motorized vehicles, non-motorized vehicles and pedestrians on roads, streets, highways, bridges, and other surface transportation media designated for such purposes. Henceforth, the term "roadway" will be used to include any surface transportation media. Traffic control systems use visible indicators to direct when travel is permitted or not permitted on designated roadways. The purpose of traffic control systems is to provide safe and efficient access to the shared roadway for a specified group of roadway users. Crosswalks are portions of the roadway that are allocated for pedestrians to cross one or more roadways. They are identified by painted markings on the roadways and/or signage on the side of the roadway as described in the Manual for Uniform Traffic Controller Devices (MUTCD) which is available at http://mutcd.fhwa.dot.gov/htm/2003r1r2/html_index.htm.

A traffic control system is comprised of an electronic device that determines which vehicle and pedestrian signals are to be active to control movements through a designated portion of the roadway. As used herein, an intersection refers to the intersection of two or more roadways that share a common right of way in such a manner that one or more traffic movements must be constrained to avoid conflicts that may result in collisions. A signalized intersection is an intersection that uses a traffic control system to control vehicle and pedestrian movements at an intersection or on a roadway. The traffic control system may incorporate sensors that detect the presence of vehicles at specific places in the roadway. The traffic control system may also have detectors to sense when pedestrians press a button that signifies that they are requesting (calling for) service to be able to cross a specific element of the roadway.

Many traffic control systems provide control of pedestrian movements using visible and audible messages and/or symbols. According to the MUTCD, visible signals used to control pedestrian movements include illuminated signals that display the words "WALK", "DON'T WALK", and "WAIT." Other traffic control systems use the illuminated symbol of a walking person in lieu of a "WALK" signal and a symbol of a hand in lieu of the "DON'T WALK" or "WAIT" signals. Some traffic control systems also include countdown timers that display the number of seconds remaining before the pedestrian is to be clear of the segment of the roadway shared with other users. In addition to the visible displays, some traffic control systems also broadcast audible messages in the form of verbal phrases or easily differentiable tones such as chirps and coo-coos that mimic bird calls.

Pedestrian movements at signalized intersections are controlled by displaying the "WALK" indication indicating that individuals should proceed to cross the designated roadway with due caution. The "WALK" display changes to a flashing "DON'T WALK" indicating that a pedestrian who is not already in the roadway should no longer leave the curb and enter the roadway. A non-flashing "DON'T WALK" display indicates to the pedestrian it is no longer safe to be in the roadway for the designated crossing.

Some pedestrian movements are controlled by the traffic controller that automatically allocates a regular fixed time interval for pedestrian crossings and requires no action by the pedestrian to register a request for service with the traffic controller. Some traffic control systems provide a sequence of displays to both vehicles and pedestrians when triggered by manual push buttons, or other pedestrian friendly features. Usually the push buttons that are used by the pedestrian to register a request for service with the traffic controller are physically positioned in the proximity of the side of the roadway adjacent to the media used by motorized vehicles. The MUTCD gives guidelines as to the placement and orientation of the pedestrian activation buttons. However, variations of roadway geometries preclude consistent and predictable placement of the pedestrian call buttons at many signalized intersections.

The operation of today's traffic control systems provide a reasonable degree of safety provided that pedestrians and vehicle operators use their sight to identify potential hazards and conflicts as well as to correctly identify the signal lights that are illuminated to control their movements. Pedestrians with cognitive and visual acuity impairments must rely on auditory cues to assist them in lieu of visual signals. The difficulties of crossing a roadway for people with cognitive and vision impairments are described in detail in Harkey et al., "Accessible Pedestrian Signals: A Guide to Best Practices" (hereinafter "Harkey") available at http://onlinepubs.trb.org/onlinepubs/nchrp/nchrp_w117a.pdf. Harkey's Appendix D (also available at http://www.walkinginfo.org/aps/appendix_d_understanding.cfm) discusses the safety and access difficulties faced by blind pedestrians. Both of these are incorporated herein by reference. Some of these difficulties are described below.

As described by Harkey, blind or visually impaired pedestrians typically travel and cross streets using human or dog guides, using long, white canes to identify and avoid obstacles, using special optical or electronic aids, or using no additional aids. In any case, according to Harkey, street crossing comprises a number of tasks that are summarized briefly below.

First, the pedestrian must determine that she has arrived at a street, typically based on one or more factors such as curb locations, ramps, traffic noise, or audible signals. Second, the pedestrian must identify the street. Streets signs are generally not helpful, and location information is usually not provided in a manner suitable for the blind. Thus, blind pedestrians often count the number of blocks and street crossings they have traveled, or ask bystanders for assistance in identifying a street crossing. Third, the blind pedestrian must assess the street/intersection configuration including such characteristics as crosswalk locations, numbers and widths of streets, presence of medians or islands, locations and availability of pedestrian push buttons, and orientations of intersection corners. While traffic noise can be helpful, traffic noise provides limited assistance, and available pedestrian push buttons may not be readily located by the blind pedestrian. Fourth, based on the configuration of the intersection, the blind pedestrian crosses based on alignment with respect to a target location on an opposite side of the roadway, activation of a pedestrian push button, and a beginning of a crossing time in response to push button activation. In some cases, traffic noise parallel to an intended direction is used as an indication that the blind pedestrian can begin to cross. This traffic noise can be helpful in establishing a proper orientation during crossing, but can be misleading as well. For example, noise associated with turning vehicles can make alignment more difficult. Typical crossing difficulties include finding and activating a crossing pushbutton—the time required to do this may seriously reduce the time available for the actual crossing. Moreover, in the absence of traffic, it may be impossible to determine that a walk interval established by a walk signal has begun or ended. In some locations, walk intervals are too short, or pedestrian push buttons are not provided or are too difficult to access. Even if a lengthy walk interval is provided, traffic often continues to flow during at least a portion of the walk time.

For the reasons identified above and other safety and access reasons, improved traffic control devices and methods are needed.

SUMMARY

In representative embodiments, an apparatus is provided that is capable of exchanging information with a suitably equipped traffic controller at a signalized intersection. The apparatus is able to register requests for service to initiate a sequence of traffic controller operations that result in a WALK signal to allow crossing one or more lanes of the roadways leading to and or from a signalized intersection. In some examples, the apparatus is able to determine its position and orientation (direction) to provide pedestrian directions. In some examples, the user interface with the apparatus uses visual, auditory and/or tactical based communications.

In some examples, a pedestrian call apparatus comprises a traffic signal locator configured to determine an availability of a suitably equipped signalized traffic intersection. A transmitter is configured to communicate with at least one traffic controller system associated with the available traffic signal so as to provide a pedestrian traffic control request for service. In some examples, a position sensor is configured to estimate a position associated with the apparatus, wherein the traffic signal locator determines the availability of the traffic signal based on the estimated position. In further examples, a memory stores traffic signal positional information for at least one traffic signal. In other examples, a receiver is configured to receive a traffic signal identifier associated with a traffic signal, wherein the traffic signal locator is configured to determine the availability of the traffic signal based on the traffic signal identifier. In further examples, an orientation sensor is configured to provide an indication of an orientation associated with the apparatus. In other examples, the transmitter is configured to communicate the estimated position and orientation. In additional representative examples, the transmitted request is based on the estimated position.

In some examples, the apparatus is configured to receive an acknowledgement signal in response to the pedestrian traffic control request, and the apparatus is operable to indicate receipt of the acknowledgement to a user by means of visual, auditory and/or tactical signals and messages. In some examples, the apparatus is configured to indicate that the position associated with the sensor is within a predetermined spatial zone associated with the pedestrian traffic control request. In other examples, the apparatus is configured to indicate that the estimated position is external to a predetermined spatial zone associated with the traffic control request and to indicate a course change to the user. In some examples, a processor is configured to produce a pedestrian alert signal indicative of at least one of a pedestrian position or orientation that is outside a predetermined spatial zone. In other examples, the apparatus is coupled to receive a pedestrian alert signal indication that the pedestrian is outside of a predetermined spatial zone, and the apparatus is coupled to produce a corresponding alert signal for delivery to the pedestrian. In other examples, the alert signal produced by the apparatus is an audible, visible, or tactile notification.

In a particular example, an orientation sensor includes a magnetometer and an accelerometer, and a position sensor includes a global positioning system sensor, wherein the transmitter is configured to wirelessly transmit estimated apparatus orientation and position.

Traffic control units comprise at least one traffic signal interface configured to control at least one traffic control system, a wireless transceiver configured to receive pedestrian requests for traffic signal control, and a processor coupled to the traffic signal interface and the transceiver. The processor is configured to establish a traffic signal condition in response to the pedestrian request and produce a request acknowledgement for transmission by the apparatus to the pedestrian. In some examples, a memory is coupled to the processor and configured to store a pedestrian transit zone definition associated with the at least one traffic signal, wherein the processor is configured to produce a pedestrian zone signal based on the pedestrian zone definition for transmission by the transceiver. In other examples, the processor is configured to produce an alarm signal operative to establish an increased transit zone in response to receipt of a pedestrian location signal or pedestrian orientation signal indicating that a pedestrian is outside a previously established pedestrian transit zone.

In some examples, apparatus comprise an orientation sensor configured to provide an indication of an orientation associated with the apparatus and a position sensor configured to provide an indication of a position associated with the apparatus. A transceiver is configured to communicate with at least one traffic controller so as to provide a pedestrian traffic control request signal to the traffic controller, the pedestrian traffic control request including at least one of the orientation indication and the position indication. In further examples, the apparatus is configured to receive an acknowledgement signal from the traffic controller in response to the pedestrian traffic control request, and a pedestrian notification transducer is operable to indicate receipt of the acknowledgement signal to a user. In other examples, the pedestrian notification apparatus is configured to indicate that the position associated with the sensor is within a predetermined spatial zone associated with the traffic control request.

In other embodiments, a processor is configured to determine that a position or orientation associated with the position sensor or the orientation sensor, respectively, is within a predetermined zone or direction associated with the traffic control request. In a particular example, the pedestrian notification transducer is coupled to the processor and configured to indicate that the position associated with the sensor is external to a predetermined zone associated with the traffic control request. In some examples, the processor is configured to produce a pedestrian alert signal indicative of at least one of a pedestrian position or orientation that is outside predetermined limits. In other embodiments, the transducer is coupled to receive the pedestrian alert signal and notify the user. In further representative examples, the transceiver is configured to communicate the pedestrian alert signal to a traffic controller. The user notification produced by the transducer is an audible, visible, or tactile notification. In other examples, the transceiver is configured to receive a signal associated with a location of the predetermined zone from the traffic controller. In further examples, a memory is configured to store a plurality of predetermined traffic zones, wherein the location of the predetermined zone is retrieved from the memory by the processor. According to representative examples, the orientation sensor comprises a magnetometer and an accelerometer, the position sensor is a global positioning system sensor, and the transceiver is a radio-frequency transceiver.

Traffic control units comprise at least one traffic signal interface configured to control at least one traffic signal and a transceiver configured to receive pedestrian requests for traffic signal control. A processor is coupled to the traffic signal interface and the transceiver, and configured to establish a traffic signal condition in response to the pedestrian request and produce a request acknowledgement for transmission by the transceiver to the pedestrian. In some examples, a memory is coupled to the processor and configured to store a pedestrian transit zone definition associated with the at least one traffic signal, wherein the processor is configured to produce a pedestrian zone signal based on the pedestrian zone definition for transmission by the transceiver. In further examples, the processor is configured to produce an alarm signal operative to establish an increased transit zone in response to receipt of a pedestrian location signal or pedestrian orientation signal indicating that a pedestrian is outside a previously established zone.

Traffic control methods comprise receiving a request from a pedestrian for activation of at least one traffic control device and determining a location of the pedestrian with respect to a traffic control zone allocated for pedestrian crossings associated with the request. A notification signal is provided to the pedestrian based on the determination. In some examples, at least a first traffic control device is activated in response to the request. In some embodiments, at least first and second traffic control devices are activated in response to the determination of the pedestrian location. In other embodiments, a record associated with the allocated pedestrian crossing zone associated with the traffic control device is stored, and a pedestrian location is compared with the allocated pedestrian crossing zone. In further examples, a pedestrian is notified that the allocated pedestrian crossing zone has been exited based on the comparison, and one or more additional traffic control devices activated.

The foregoing and other objects, features, and advantages will become more apparent from the following detailed description, which proceeds with reference to the accompanying figures.

DETAILED DESCRIPTION

As used in this application and in the claims, the singular forms "a," "an," and "the" include the plural forms unless the context clearly dictates otherwise. Additionally, the term "includes" means "comprises." Further, the term "coupled" means electrically or electromagnetically coupled or linked and does not exclude the presence of intermediate elements between the coupled items. Such coupling can be based on physical connections such as wired connections, or wireless connections based on, for example, optical, infrared, or radiofrequency communications.

The systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed systems, methods, and apparatus can be used in conjunction with other systems, methods, and apparatus. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

Figure 1:
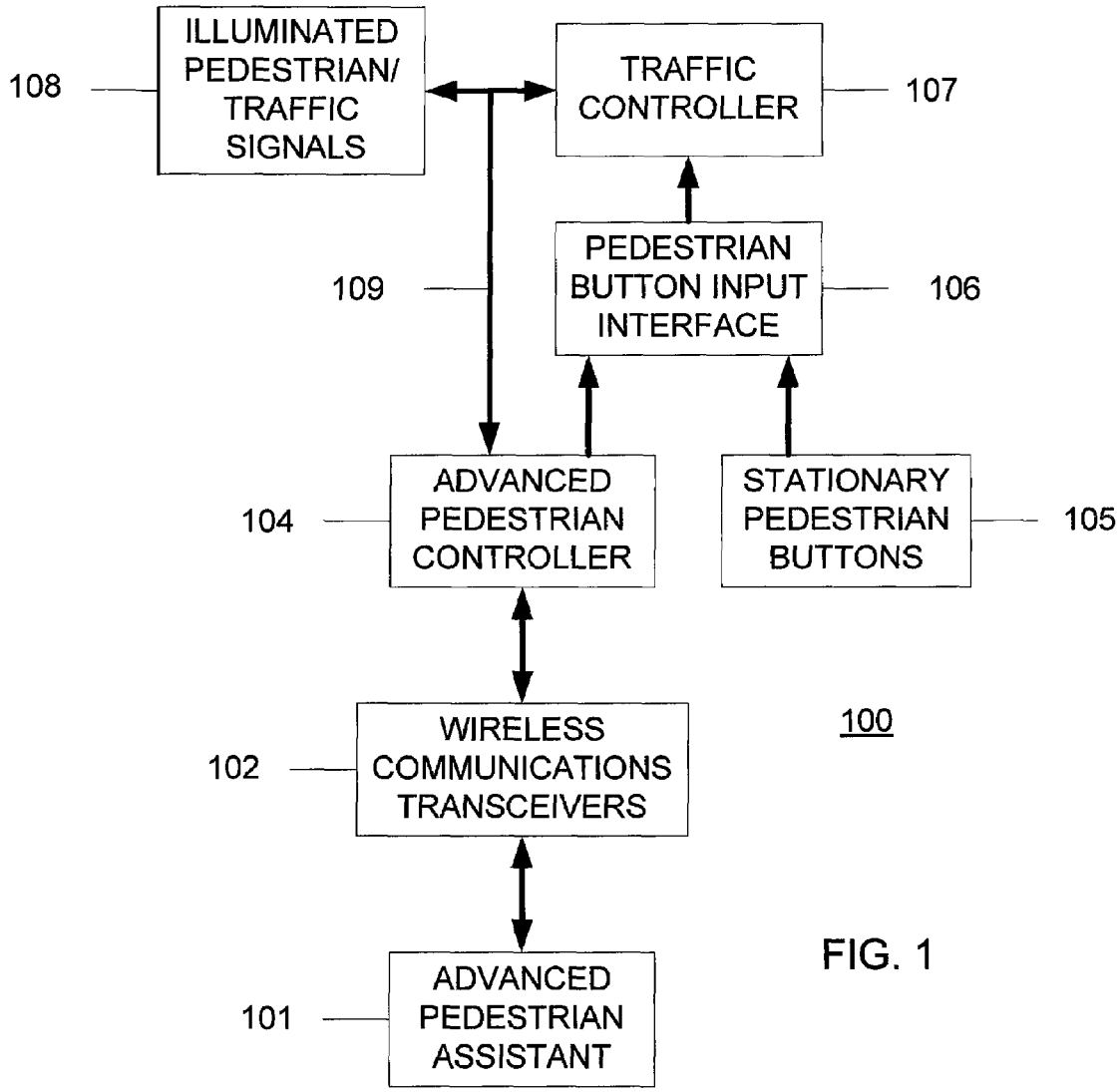
FIG. 1 is a simplified functional block diagram of a traffic control system that includes an interface operable to communicate wirelessly with a pedestrian-operated mobile controller.

Referring to FIG. 1, an Advanced Accessible Pedestrian Control System for the Physically Disabled (AAPCS) 100 typically comprises a mobile portable electronic device referred to herein as an Advanced Pedestrian Assistant or Mobile Pedestrian Communicator 101, one or more wireless communications transceivers 102 that can serve as bridges or repeaters, and an Advanced Pedestrian Controller (APC) 104. The APC 104 employs direct wired connections 109 to place pedestrian requests for service in a manner identical to conventional methods of placing pedestrian requests for service from one or more stationary pedestrian buttons 105 coupled to a pedestrian button input interface 106. The APC 104 detects the state of traffic signals by, for example, monitoring the voltages that illuminate the traffic and pedestrian signal lights 108 and/or the control signals that determine which signal lights are turned on using the direct wired interface 109. The state of traffic control devices can be obtained directly from a traffic controller 107 as well.

The APC 104 exchanges information with the Mobile Pedestrian Communicator 101 using one or more wireless communication transmitters, receivers, or transceivers 102. Bi-direction communication between the Mobile Pedestrian Communicator 101 and APC 104 is generally preferred and allows the exchange of information such as that described above. Typically, wireless communication uses radio frequency communications such as can be provided using wireless networking apparatus associated with computer networking, cell phones or optical or infrared communications, or a dedicated wireless connection. Representative wireless systems can be based on the so-called ZIGBEE or BLUETOOTH communication protocols, or other protocols as may be convenient.

Figure 4:
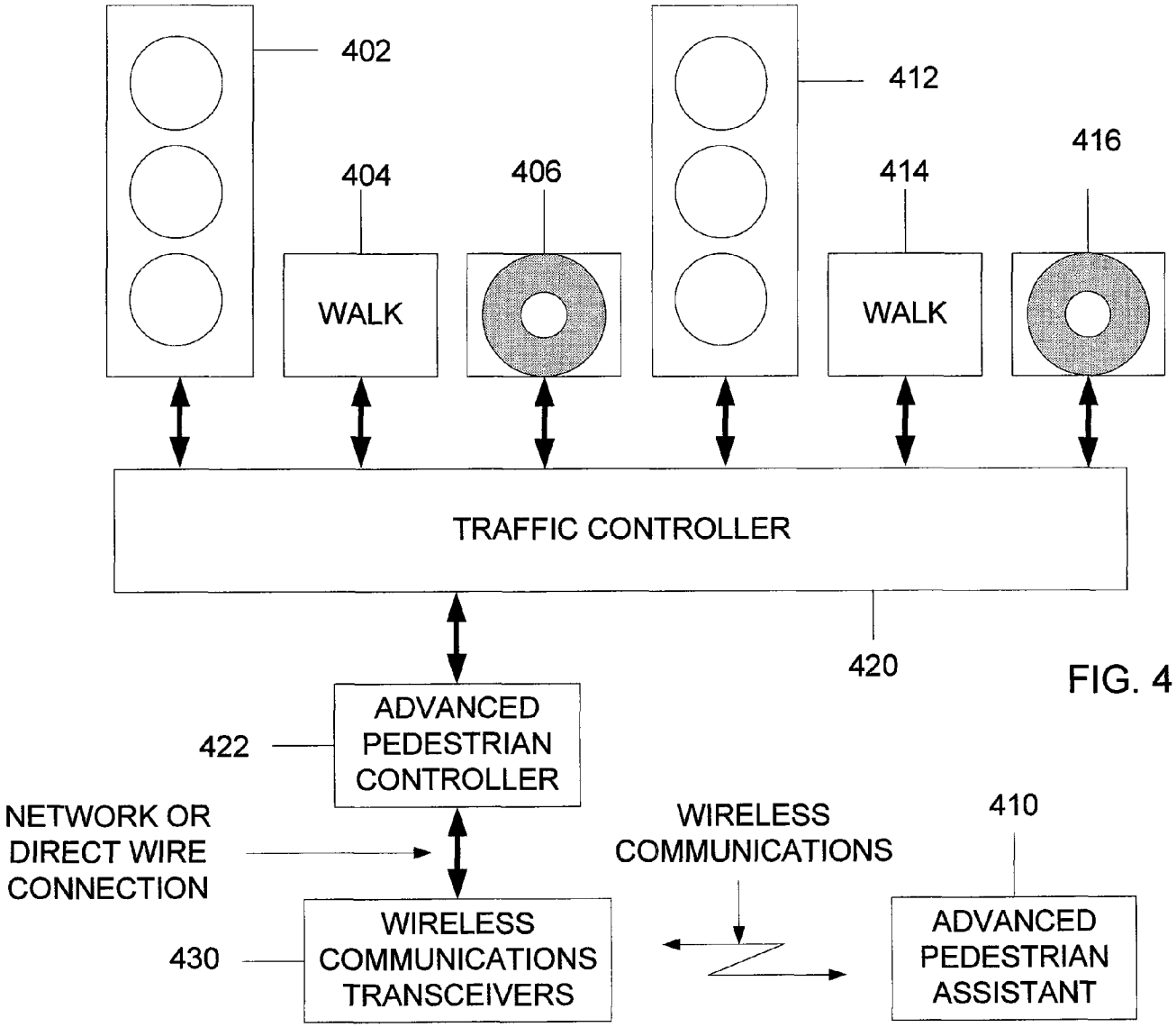
FIG. 4 is a schematic diagram of a representative traffic control system configured to receive a request for services from a pedestrian and to control traffic signals.

Referring to FIG. 4, a typical configuration of traffic control devices at an intersection or other location includes traffic signals 402, 412 that are associated with respective pedestrian crossing signals 404, 414 and associated manual push buttons 406, 416 that are coupled to a traffic controller 420. Typically, audible or other alarms are provided for visually impaired pedestrians or other pedestrians having special needs in addition to the pedestrian crossing signals 406, 416. An Advanced Pedestrian Assistant 410 is situated so as to exchange communications with the traffic controller 420 via an Advanced Pedestrian Controller (APC) 422. The Advanced Pedestrian Assistant 410 can be configured to include position and orientation sensors and to receive and/or store street or walkway maps that include locations that identify pedestrian crosswalks. In some examples, the Advanced Pedestrian Assistant 410 can be configured to communicate a current location to the traffic controller 420 or the APC 422 so that pedestrian progress along a crosswalk can be monitored, and traffic control devices appropriately controlled for pedestrians that remain along or wander away from the preferred path. Typically, the Advanced Pedestrian Assistant 410 is configured for bidirectional communication with a traffic controller, a traffic control system, a database of street and crossing information, the Internet, or other network, and includes position and orientation sensors operable for instructing a pedestrian for the most advisable transit based upon the intersection geometry and for monitoring transit. As shown in FIG. 4, the APC 412 is provided for communication between the traffic controller 420 and the Advanced Pedestrian Assistant 410, but can be included in the traffic controller 420.

The traffic control system of FIG. 1 can be configured to control a plurality of traffic control devices such as traffic signals, pedestrian WALK/DON'T WALK signs, traffic sensors, and other devices. In addition, the traffic controller can be configured to communicate with other traffic controllers or with a central or local traffic center. Some network configurations are described in Wall et al., U.S. Patent Application Publ. 2008/0218380, which is incorporated herein by reference. Communications can include representations of pedestrian positions, traffic signal control requests, orientations, intended destinations, transit speed or other pedestrian physical parameters, acknowledgements, crosswalk or street locations or other characteristics such as curb cut locations or presence of bike lanes, turning lanes, center medians, or other information or instructions.

Figure 2:
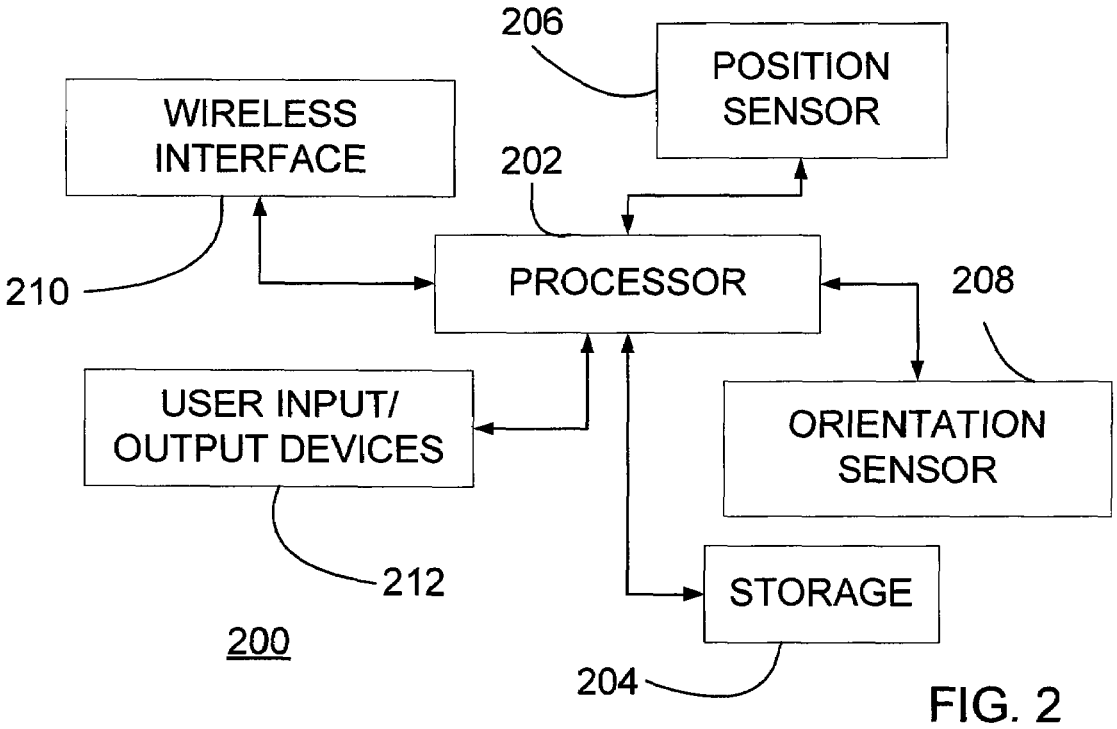
FIG. 2 is a schematic diagram of an advanced pedestrian assistant that includes position and orientation sensors.

With reference to FIG. 2, an adaptive pedestrian assistant 200 includes a processor 202 that is coupled to a memory 204 such as RAM, DRAM, a hard disk, a floppy disk, or other digital storage medium. The processor 202 typically includes at least some on-board memory as well. The memory 204 can be configured to store user data, geographic data, traffic data, and other data as well as processor-executable instructions for communication with a traffic controller or a traffic network, and provide instructions to a pedestrian to promote a predetermined transit route. The memory 204 can also store frequent route information, user communication preferences (for example, audio or vibro-tactile, earcon selections), and other user customizations.

The Advanced Pedestrian Assistant 200 typically includes a position sensor 206 and an orientation sensor 208 that are coupled to the processor 202. The position sensor 206 can conveniently include a GPS position system so that a position of a pedestrian can be determined so that, for example, pedestrian location in a predetermined transit crosswalk can be evaluated, communications with nearby traffic control devices can be established, or instructions can be generated to direct the pedestrian along an intended route. The orientation sensor 208 typically includes a magnetometer or electronic compass that is coupled so that the processor is operable to determine or communicate pedestrian orientation. In some examples, the processor can generate pedestrian instructions so that a pedestrian follows a specific route. For example, a visually impaired pedestrian can be provided with specific directions for safety and convenience, and pedestrian location and direction of travel can be updated and tracked in conjunction with traffic signal control so that instructions can be updated or alarms or warnings provided as transit progresses. In some cases, such updated location or orientation information can be reported to the processor or a traffic controller so that traffic can be more generally halted or controlled if the pedestrian exits a predetermined zone.

The Advanced Pedestrian Assistant 200 also includes a wireless interface 210 that is operable to communicate position, orientation, requests for service, services status, and other data and instructions with traffic controllers, traffic control networks, or other networks, pedestrian assistants, or other wireless devices. User inputs/outputs 212 are also provided so that a user can request traffic control services, or receive audible, visible, or tactile feedback concerning transit routes, intersection geometries, or to confirm receipt and delivery of instructions, data, or other messages. The wireless interface 210 can also be configured to communicate with a wireless access point, a cell phone network, or other network so that the Advanced Pedestrian Assistant can receive directions or other information from Internet-based sources. While a dedicated wireless interface can be provided, interfaces based on wireless networking standards or cellular standards can be used. For example, the Advanced Pedestrian Assistant can be configured to communicate with a traffic controller or other devices using a cellular network via short message service (SMS) messages.

Figure 3:
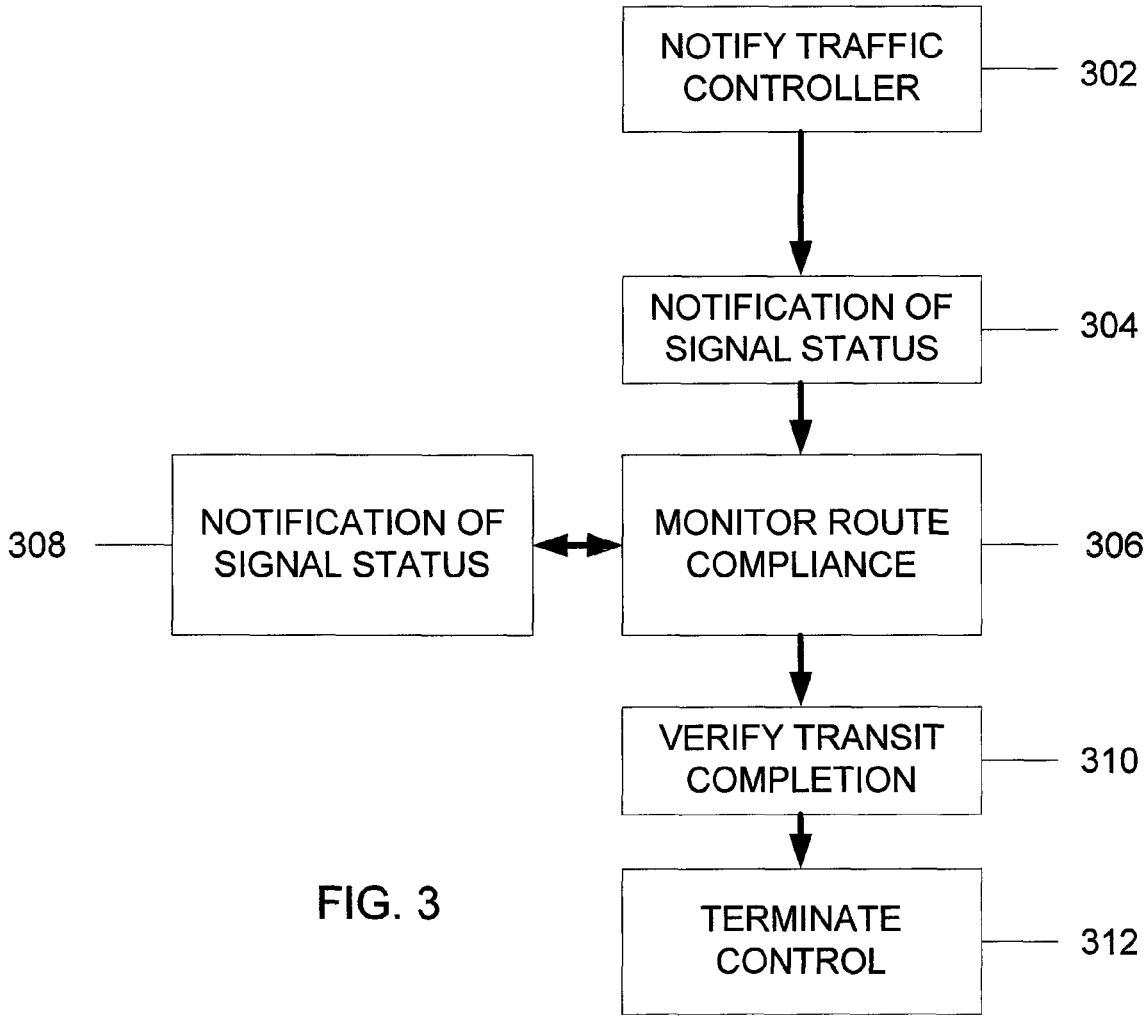
FIG. 3 is a block diagram of a traffic control method for requesting operation of traffic control devices so as to be authorized for transit of an intersection, a single street, or other traffic location.

Referring to FIG. 3, a typical example of transit using a pedestrian assistant includes notifying a traffic control device of a pedestrian request in an action 302. In response to the pedestrian request, a transit signal status indicating permission to enter the crosswalk is transmitted to a pedestrian assistant or otherwise announced or communicated in an action 304. For example, a communication can be directed to a pedestrian assistant to produce an associated vibro-tactile confirmation. With the pedestrian in transit, the pedestrian assistant, the traffic controller, or a combination of such devices or other monitoring devices receives location and/or orientation data for comparison with a preferred transit path and/or direction in action 306. During transit, notifications of signal status continue to be sent or received in an action 308. Transit completion can be verified in an action 310 based on, for example, a user-activated verification or user location or orientation data. In an action 312, control responsive to the pedestrian assistant is terminated.

The pedestrian assistant can be used with intersections of various geometries and configurations such as roundabouts, offset streets, streets with center medians, left or right turn lanes, and bike lanes. The pedestrian assistant can be configured to communicate with a nearby traffic controller or a remote device, or a remote traffic database to acquire information concerning an intersection and supply information to a user.

In some examples, vibro-tactile indications can be provided to inform a user of errors in or relative accuracy of navigation. Different vibrational patterns (such as a sequence of short vibrations, long vibrations, or a pattern thereof, or different vibrational frequencies) can be used to indicate deviation from a target path as well as provide information concerning a recommended correction. For example, a steady low amplitude vibration could indicate satisfactory progress, a sequence of short vibrations indicate that a rightward reorientation is needed, and a steady sequence of long vibrations could indicate that a leftward adjustment is needed. As another example, vibro-tactile feedback could be provided only during a walking (transit) phase, such as vibrations of differing rates or distinctive patters such as a dash-dash pattern for angle left and dot-dash-dot for angle right, along with auditory (spoken) directions urging "too far right" or "too far left."

Different vibrational frequencies or amplitudes could be used to indicate that a pedestrian is nearing the edge of a predetermined or legally established passage route, or that such a route has already been exited. In addition, spoken or other auditory commands or communications can be provided based on musical passages, tones, alarms, spoken commands, male or female voices, or other sounds. Typically, such auditory commands should be provided in a manner consistent with local traffic, such as at increased volumes in the presence of increased local traffic noise or other local noise. In addition, such auditory commands or communications preferably are provided so that local environmental auditory background remains available for the pedestrian, as such background is perceived as valuable to visually impaired pedestrians. For example, a pedestrian generally prefers to continue to hear local traffic noise to determine appropriate transit times and to establish roadway direction by listening for parallel traffic.

In some examples, audio output devices such as earphones, ear buds, speakers, or other devices can be coupled with an audio input device such as a microphone so that environmental sounds are combined with instructions or other communications so that the pedestrian can take advantage of both types of sounds. Alternatively, ambient noise levels can be measured. In any case, output levels can be adjusted so that users can react to both sound types. As noted above, in some examples, vibro-tactile communications are preferred, but audible communications should generally be provided as well. Auditory message volume adjustments can be automatically based on ambient noise with or without user preferences, or such adjustments can be made manually. Typically, commands/messages are at volumes between about 2-5 dB greater than ambient noise. In one example, increased or decreased message volume can be selected in response to a duration for which an associated switch is activated by a user, such as how long a user depresses a push button.

In some examples, a pedestrian assistant can identify (based on, for example, GPS position information) a current intersection so that subsequent commands and information can be based on the existing user knowledge. This information can be relayed to the user as one or more auditory messages. Alternatively, a user can provide intersection information. In either case, subsequent commands and instructions can be based on this pre-existing information. Errors in intersection identification can be reported promptly to the user with an auditory warning message.

In other examples, audio beaconing can be requested as well. In this case, audio beacons can be relatively quiet unless audible beaconing is requested by, for example, depressing a signal push button or requested remotely with a pedestrian assistant. In response, a speech message can be provided that indicates the address of the intersection.

In addition, the pedestrian assistant can interrogate a signal or controller to determine current state before or after requesting services. For example, the pedestrian assistant can wirelessly forward a request, and report a response with an auditory message such as "red light," "green light," "don't walk," or generate a sound that is used to represent a specific event or object (referred to as an "earcon") so that the user remains informed, even while waiting to initiate a crossing.

While a standard pedestrian walking rate of about 3.5 to 4.0 feet/second can be used in signal timing, a user can provide a custom rate that is communicated to a signal controller or is used to generate repeated requests to a controller to maintain a condition that is favorable to transit for a longer or shorter time period. This rate can be stored in a user device or in a networked database for look-up by a traffic controller in response to a user identification received from the user device. In addition, even prior to arrival at curbside, a user can be informed by the pedestrian assistant that curb ramps are present so that the user is aware of the ramps and can thus locate a street entrance.

As noted above, the pedestrian assistant can provide instructions concerning a preferred course that is favorable for transit. For example, at a corner, the pedestrian assistant can issue a communication requesting that the user indicate whether the user knows a preferred destination. In response to an inquiry from the pedestrian assistant, the user can indicate a desired crossing. If the user does not indicate a particular crossing, the traffic control or other network component can generate or look-up a recommended route for communication to the pedestrian assistant. If accepted by the user, nearby signal controllers can be directed to implement signal control consistent with this route. Alternatively, the pedestrian assistant can merely inform the user of a current location and await additional requests or instructions. While the pedestrian assistant can provide extensive direction and location information, it can also be coupled to a remote infra-red receiver for use with so-called "Remote Infrared Audible Signage Systems."

In some examples, satisfactory pedestrian assistant performance depends on signal detection, location errors, mean square distance from prime crosswalk path, orientation errors, and other factors. Typically, suitable limits can be established for general use or can be custom tailored (by user selection or automatically based on a location reported to the assistant via GPS). In addition, the assistant can record typical user transit errors, and process actual locations of legal crossing zones such as crosswalks or typical transit times and orientations to provide user-tailored instructions.

While the pedestrian assistant is especially useful in requesting signal services and directing and verifying transit, the pedestrian assistant can also be used to identify the location and type of signals, even signals and controllers that are not configured to communicate with a pedestrian assistant.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. An apparatus, comprising:

a traffic signal locator configured to determine an availability of a traffic signal;

a transmitter configured to communicate with at least one traffic controller associated with the available traffic signal so as to provide a pedestrian traffic control request associated with establishment of a pedestrian crossing zone; and a receiver configured to receive a notification that the pedestrian crossing zone has been established and that a pedestrian associated with the traffic control request has exited the established pedestrian crossing zone.

2. The apparatus of claim 1, further comprising a position sensor configured to estimate a position associated with the apparatus, wherein the traffic signal locator determines the availability of the traffic signal based on the estimated position.

3. The apparatus of claim 1, further comprising a memory storing traffic signal positional information for at least one traffic signal.

4. The apparatus of claim 1, wherein the receiver is configured to receive a traffic signal identifier associated with a traffic signal, wherein the traffic signal locator is configured to determine the availability of the traffic signal based on the traffic signal identifier.

5. The apparatus of claim 2, further comprising an orientation sensor, configured to provide an indication of an orientation associated with the apparatus.

6. The apparatus of claim 2, wherein the transmitter is configured to communicate the estimated position and orientation.

7. The apparatus of claim 2, wherein the transmitted request is based on the estimated position and orientation.

8. The apparatus of claim 2, further comprising a communication transducer operable to indicate receipt of the notification.

9. The apparatus of claim 8, wherein the communication transducer is configured to indicate that the position associated with the sensor is within a predetermined zone associated with the pedestrian traffic control request.

10. The apparatus of claim 9, wherein the communication transducer is a vibro-tactile transducer.

11. The apparatus of claim 2, further comprising a communication transducer configured to indicate that the estimated position is external to a predetermined zone associated with the traffic control request.

12. The apparatus of claim 11, further comprising a processor configured to produce a pedestrian alert signal indicative of at least one of a pedestrian position or orientation that is outside a predetermined limit.

13. The apparatus of claim 8, wherein the communication transducer is coupled to produce an alert signal for delivery to the pedestrian based on the notification that the pedestrian has exited the established pedestrian crossing zone.

14. The apparatus of claim 13, wherein the alert signal produced by the transducer is an audible, visible, or vibro-tactile notification.

15. The apparatus of claim 13, wherein the transducer is coupled to produce at least first and second alert signals indicative of a preferred pedestrian travel direction with respect to the established pedestrian crossing zone.

16. The apparatus of claim 1, further comprising:

an orientation sensor that includes a magnetometer and an accelerometer;

a position sensor that includes a global or local positioning system sensor, wherein the transmitter is configured to wirelessly transmit estimated apparatus orientation and position.

17. The apparatus of claim 1, further comprising:

an orientation sensor that includes a magnetometer and an accelerometer;

a position sensor that includes a global or local positioning system sensor configured to provide an estimated pedestrian position; and a processor coupled to the orientation sensor and the position sensor to determine a whether the estimated pedestrian position and orientation are within the established pedestrian crossing zone.

18. The apparatus of claim 1, wherein the pedestrian traffic control request is a request for a traffic signal to activate a walk signal.

19. A traffic control unit, comprising:

at least one traffic signal interface configured to control at least one traffic signal;

a radiofrequency transceiver configured to receive pedestrian requests for traffic signal control; and a processor coupled to the traffic signal interface and the transceiver, and configured to establish a traffic signal condition associated with establishment of a predetermined crossing zone in response to the pedestrian request and produce a request acknowledgement for transmission by the transceiver to the pedestrian, wherein the processor is further configured to produce an alarm signal operative to pedestrian an is outside the predetermined crossing zone established in response to the pedestrian request.

20. The traffic controller of claim 19, further comprising a memory coupled to the processor and configured to store at least one legal and/or established pedestrian crossing zone definition associated with the at least one traffic signal, wherein the processor is configured to produce a pedestrian zone signal based on the pedestrian zone definition for transmission by the transceiver.

21. The traffic controller of claim 20, wherein the processor is configured to produce an alarm signal operative to extend the predetermined crossing zone in response to receipt of a pedestrian location signal or pedestrian orientation signal indicating that a pedestrian is outside the predetermined crossing zone.

22. A traffic control method, comprising:

receiving a request from a pedestrian for activation of at least one traffic control device associated with establishment of a safe transit zone;

storing a record associated with at least one safe transit zone associated with the traffic control device, and comparing a pedestrian location with the at least one established safe transit zone;

activating at least a first traffic control device in response to the request so as to establish at least one safe transit zone; and notifying a pedestrian that the established safe transit zone has been exited based on a comparison of a current pedestrian location and the established safe transit zone, and providing an additional traffic control device activation signal so as to provide an extended safe transit zone.

* * * * *